US011773476B2

(12) United States Patent
Grewe et al.

(10) Patent No.: US 11,773,476 B2
(45) Date of Patent: Oct. 3, 2023

(54) METHOD FOR PRODUCING A MOTOR VEHICLE COMPONENT FROM A 6000-SERIES ALUMINUM ALLOY

(71) Applicant: BENTELER AUTOMOBILTECHNIK GMBH, Paderborn (DE)

(72) Inventors: Jochem Grewe, Salzkotten (DE); Feng Jiao, Paderborn (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 780 days.

(21) Appl. No.: 16/776,884

(22) Filed: Jan. 30, 2020

(65) Prior Publication Data

US 2020/0248292 A1 Aug. 6, 2020

(30) Foreign Application Priority Data

Jan. 31, 2019 (DE) ..... 10 2019 102 506.0

(51) Int. Cl.
*C22F 1/05* (2006.01)
*B21D 22/02* (2006.01)
(Continued)

(52) U.S. Cl.
CPC ..... *C22F 1/05* (2013.01); *B21D 22/02* (2013.01); *C21D 9/46* (2013.01); *C22C 21/02* (2013.01);
(Continued)

(58) Field of Classification Search
None
See application file for complete search history.

(56) References Cited

U.S. PATENT DOCUMENTS

2012/0273098 A1* 11/2012 Bohner ..... C22F 1/053 148/695
2019/0040507 A1 2/2019 Grewe et al.

FOREIGN PATENT DOCUMENTS

CN 106170577 A * 11/2016 ..... C22F 1/002
DE 102017117675 A1 2/2019
EP 2518173 A1 10/2012

OTHER PUBLICATIONS

Davis, J.R. "Metals Handbook Desk Edition", 2nd Edition, pp. 426-436 & 782-789. (Year: 1998).*
(Continued)

*Primary Examiner* — George Wyszomierski
*Assistant Examiner* — Janell C Morillo
(74) *Attorney, Agent, or Firm* — HAUPTMAN HAM, LLP

(57) ABSTRACT

The present disclosure relates to a method for producing a motor vehicle component from a 6000-series aluminum alloy having the following method steps: providing a blank made of a 6000-series aluminum alloy, rapid heating of the blank by means of contact plates to a temperature between 450° C. and 600° C. in a time less than 20 seconds, ending of the heating procedure and optional homogenizing when a grain size between 20 and 50 μm has resulted, quenching the blank thus tempered to a temperature less than or equal to 100° C., in a time less than 20 seconds, wherein the rapid heating and quenching of the blank is carried out in a total time of less than 50 seconds, applying a lubricant, at 20° C. to 100° C., forming the cooled blank in a forming tool, wherein the time between beginning the rapid heating and beginning the forming is less than 45 seconds, aging.

21 Claims, 6 Drawing Sheets

(51) Int. Cl.

| | |
|---|---|
| ***C21D 9/46*** | (2006.01) |
| ***C22C 21/08*** | (2006.01) |
| ***C22C 21/14*** | (2006.01) |
| ***C22C 21/16*** | (2006.01) |
| ***C22C 21/02*** | (2006.01) |
| *B21D 53/88* | (2006.01) |
| *B21D 53/74* | (2006.01) |

(52) U.S. Cl.
CPC ..... *C22C 21/08* (2013.01); *C22C 21/14* (2013.01); *C22C 21/16* (2013.01); *B21D 53/74* (2013.01); *B21D 53/88* (2013.01)

(56) References Cited

OTHER PUBLICATIONS

Davis, J.R. "Aluminum and Aluminum Alloys", ASM International, pp. 294, 684-685. (Year: 1993).*
Office Action for German Application No. 10 2019 102 506.0 dated Sep. 9, 2019; 16pp.
Kammer C., "Aluminium Paperback. 1 fundamentals and materials" Aluminium-Verlag Duesseldorf, 2002, 16th Edition; pp. 683-685 and 691; 12pp.

* cited by examiner

METHOD FOR PRODUCING A MOTOR VEHICLE COMPONENT FROM A 6000-SERIES ALUMINUM ALLOY

RELATED APPLICATIONS

The present application claims priority of German Application Number 10 2019 102 506.0 filed Jan. 31, 2019, the disclosure of which is hereby incorporated by reference herein in its entirety.

FIELD

The disclosure relates to a method for producing a motor vehicle component from a 6000-series aluminum alloy.

Furthermore, the present disclosure relates to the use of an aluminum alloy for producing a motor vehicle component.

BACKGROUND

Producing motor vehicle components from metallic material is known from the prior art. Structural components of a self-supporting motor vehicle body, but also add-on parts such as bumpers, crash boxes, or the like and also vehicle body parts, for example a door blank, roof skin, engine hood, or fender are produced from metallic material. Forming methods such as deep-drawing are used for this purpose.

Such motor vehicle components typically have a wall thickness of 0.5 to 5 mm, or 1 to 3 mm.

Safety-relevant components, for example longitudinal beams, motor vehicle columns, or B columns, rocker panels, or also crossbeams sometimes require high strengths, in order to provide a sufficient rigidity in case of an accident and/or for reinforcing the vehicle body.

Therefore, using the hot forming and press hardening technologies in the case of steels is known from the prior art. Alternatively, vehicle body components are produced from a light metal alloy, like from aluminum alloys. For this purpose, thermally treating a motor vehicle component made of an aluminum alloy before, during, and/or after the production method, in order to thus intentionally influence the strength properties, is in turn known, for example, from EP 2 518 173 A1.

SUMMARY

The object of the present disclosure is to disclose, proceeding from the prior art, a production method for a motor vehicle component made of an aluminum alloy, which can be produced cost-effectively, but simultaneously highly effectively in the strengths to be achieved.

The above-mentioned object is achieved according to the disclosure by a method for producing a motor vehicle component from a 6000-series aluminum alloy.

The above-mentioned object is furthermore achieved by a use of an aluminum alloy.

The method for producing a motor vehicle component from a 6000-series aluminum alloy is characterized by the following method steps:

- providing a blank made of a 6000-series aluminum alloy,
- rapid heating of the blank by means of contact plates to a temperature between 450° C. and 600° C. in a time less than 20 seconds, or less than 15 seconds,
- ending of the heating procedure and optional homogenizing when a grain size between 20 and 50 μm has resulted,

- quenching the blank thus tempered to a temperature less than or equal to 100° C., or in a time less than 20 seconds, or less than 15 seconds,
- wherein the rapid heating and quenching of the blank is carried out in a total time of less than 50 seconds, or less than 45 seconds, or less than 40 seconds,
- applying a lubricant, at 20° C. to 100° C.,
- forming the cooled blank in a forming tool, wherein the time between beginning the rapid heating and beginning the forming is less than 50 seconds, or less than 45 seconds, or less than 40 seconds,
- optionally removing, cleaning of residues, lubricants from the preceding processing steps,
- aging, in at least 1 step by natural and/or artificial aging and/or stabilizing.

A blank made of a 6000-series aluminum alloy is thus firstly provided. It is in the roll-hardened state F or T4 or T6 according to EN515. The state F means roll-hardened state without heat treatment. This blank can already be trimmed close to the final contour, for example. However, this would only be one option.

According to the disclosure, rapid heating, also called warming or heating, is now carried out. Contact heating by means of contact plates is used for this rapid heating. For this purpose, the heat of the contact plate is relayed to the blank by means of heat conduction upon facility contact. The blank is heated according to the disclosure to a temperature between 450° C. and 600° C. at a heating rate of greater than 15 K/s, in a time less than 20 seconds, or less than 15 seconds, but at least in a few seconds. The rapid heating can take place on one heating station. However, the rapid heating can also take place on multiple heating stations and/or in multiple steps. For example, the rapid heating can be carried out in two steps or three steps. The respective facility contact in one heating step is less than 5 seconds. A transfer time between the steps is also less than 5 seconds, or 2 seconds to 3 seconds. The transfer can be performed using an axial conveyor, for example using a transfer bar.

As soon as the target temperature is reached by the heating procedure, the blank is supposed to have this temperature homogeneously over its area and over its wall thickness. Homogenizing, which lasts at most a few seconds, however, could optionally be carried out. At the end of this heating procedure, a grain size in the material microstructure of the heated blank between 20 and 50 μm has resulted. The grain size is measured equiaxially, which means in all directions. The grain size has resulted during the heating procedure and no longer changes in the following process. The heated blank is subsequently quenched. The quenching is rapid cooling which can also be carried out in multiple steps, or in one to three steps. The blank is quenched in this case to a temperature less than or equal to 100° C.

Thereafter or between two cooling steps at 20° C. to 100° C., a lubricant can optionally be applied to the blank. The lubricant application is performed by means of spraying, squeegeeing, rolling, alternatively the lubrication can be performed in the forming step itself. Lubricant is applied to forming jaws of the forming tool. The advantage in the case of cold forming is that any lubricant can be used, it does not have to be thermally resistant.

Subsequently thereto, the cooled and/or quenched blank is laid in a forming tool and formed here. The forming thus takes place as cold forming. It is provided in this case that the time between beginning the rapid heating and the beginning of the forming is less than 50 seconds, or less than 45 seconds, or less than 40 seconds. This means that the quenching and the transfer into the forming tool are carried out in a time less than 30 seconds. If the forming is carried out in a short time after the quenching, the blank thermally pretreated in this way has a low yield strength of approximately 100 MPa, or also only 80 MPa. Therefore, only low forming forces are necessary, small press drives and small press frames can be used, which in turn reduces the production costs. The component then obtains the desired hardness due to the subsequent aging.

The quenching to a temperature less than 100° C. is carried out at a cooling rate greater than 10 K/s, or greater than 15 K/s.

The forming itself can also be carried out in multiple steps, or in one to three steps. Optionally, further trimming and/or perforating operations can be carried out during the forming process or also after the forming process.

The method according to the disclosure may be carried out in a press system having a jointly driven ram. This means that the heating steps, the quenching steps, and the forming steps are carried out in one press system. In the cycle of the press, which is executed in less than 10 seconds, or less than 5 seconds, or less than or equal to 3 seconds, but at least at 1 second, an inserted blank can thus be heated beginning in the first step. In the next cycle, this blank heated in the first step is transferred into a second step, for example also a heating step, and heated further here. The second heating step is also used, for example, for homogenizing the temperature within the blank, for example in the form of a brief holding phase. In the next cycle, for example, a first cooling step then follows, followed in turn by a second cooling step. A first forming step then follows the cooling steps in the next cycle, followed in turn by a second and optionally a third forming step. The blank can be trimmed before the first forming step or within it. Edge trimming is performed. The opening and closing movement of the press system is thus executed jointly. However, this does not have to mean that all steps have to be opened or closed in parallel with respect to time. A time offset between forming steps and tempering steps is permissible in the scope of the disclosure, for example, to induce various closing times/keeping closed times, or to maximize the contact time during the tempering. A transfer system is provided between the individual steps. A blank inserted at the beginning thus passes through all steps and is formed into the motor vehicle component.

Individual steps for the heating and/or quenching, are carried out by means of contact plates. This means that both the heating is carried out by facility contact of contact plates and also the quenching is carried out by facility contact of, in this case, cooling plates. Spring-loaded contact plates can be used here, so that the contact plates protrude in the press stroke direction when the tool is open. During the closing movement, the contact time of the contact plates during the cycle is thus extended. The introduced energy can be more effectively utilized for heating and cooling in this way.

At the same time, the method can be carried out in a energy-efficient manner in short cycle times and thus very cost-effectively overall, even during the production of more complex components.

For this purpose, an aluminum alloy is used which comprises the following alloy elements, expressed in weight-percent:

| | |
|---|---|
| silicon (Si) | 0.60 to 1.00, or 0.60 to 0.90 |
| magnesium (Mg) | 0.65 to 0.95 |
| copper (Cu) | 0.25 to 0.90 |

remainder aluminum and smelting-related contaminants.

Furthermore, the aluminum alloy has a proportion of copper, expressed in weight-percent of 0.25 to 0.65, or 0.40 to 0.65. A moderate-strength component is thus produced.

Alternatively, the proportion of copper can also be 0.65 to 0.90 weight-percent. In this way, it is possible to produce a high-strength component.

Furthermore, a lean alloy concept employing copper is utilized, which generates heat-stable, strength-forming phases in conjunction with the magnesium and the aluminum.

The following are provided individually or together in the above-mentioned aluminum alloy as further alloy elements, expressed in weight-percent.

| | |
|---|---|
| manganese (Mn) | 0.10 to 0.20 |
| chromium (Cr) | up to 0.10 |
| titanium (Ti) | 0.01 to 0.10 |
| iron (Fe) | 0.10 to 0.30. |

The copper provides for strength and thermal stability, furthermore for the recrystallization process and the aging behavior.

The manganese proportion ensures increased strength and the changing of the grain size. Furthermore, manganese and chromium are used as retarders of the recrystallization. Chromium furthermore enhances the crash behavior. Titanium ensures grain refinement during the solidification.

The above-mentioned aluminum alloy thus has optimized properties for an accelerated solution annealing treatment and also optimum cold forming properties at the same time. In conjunction with a rapid heating rate, an extremely fine grain size and/or grain structure can thus be set during the heating procedure.

At the same time, the material has improved flow behavior, so that critical thinning is avoided during the forming, or in the case of deep-drawing procedures.

It can optionally also be provided that after completion of the forming procedure, before the aging, an intermediate annealing treatment is carried out at 100° C. to 200° C. for 10 to 120 minutes.

During the stabilizing occurring following the method according to the disclosure, it is provided that the formed motor vehicle component is artificially aged at a temperature greater than 60° C. and less than 160° C. and a time of less than 6 hours, or less than 1 hour, or less than one half-hour.

The motor vehicle component produced using the method according to the disclosure from a 6000-series aluminum alloy thus has optimized mechanical properties, or if the above-mentioned aluminum alloy is used. A yield strength Rp0.2 greater than 260 MPa, or greater than 280 MPa can thus be set. In the case of a moderate-strength component, however, the yield strength is to be less than 340 MPa, or less than 320 MPa. In the case of a high-strength component, the yield strength Rp 0.2 is have greater than 320 MPa, or greater than 340 MPa. However, according to the current understanding, the yield strength of the component is less than 400 MPa. Furthermore, a tensile strength Rm on the produced motor vehicle component greater than 320 MPa, or greater than 340 MPa can be set. However, according to the current understanding, the tensile strength is less than 400 MPa.

An optimum of strength and ductility to be reached can be achieved at a ratio of yield strength to tensile strength less than or equal to 0.95.

In the scope of the disclosure, contact heating is carried out for the heating and contact cooling is carried out for the quenching. However, other heating methods, or rapid heating methods, can also be used. For example, electrical resistance heating can be carried out. Convection heating methods, radiant heating methods, or also contactless heating methods, for example, via induction, can also be carried out.

Furthermore, heating in the fluidized bed is suitable to achieve optimum microstructure formation at the required heating rates. In this case, the blanks are heated in an air-permeated heated container or a basin. The container or the basin, respectively, is filled with aluminum oxide powder.

Alternatively, it is also conceivable that inductive blank heating or also heating by means of infrared radiation is carried out for a rapid heating rate. The blank can also be heated in a furnace, wherein in the furnace a heated air stream is conducted at an angle, perpendicularly, onto the blank to be heated. This heating method, in contrast to contact heating, is suitable for heating three-dimensionally formed profiles. A flat blank is not heated in this case, but rather a profile, which is formed, for example, hat-shaped in cross section or as a multi-chamber profile. The heat can thus also penetrate into profile cavities by way of thermal radiation and/or convection and thus, for example, also heat inner webs in a profile. In the case of heating in a furnace, a heating rate of greater than 4 to 15 K/s, to achieve an increased amount of fine-grained structure during the solution annealing. A dwell time in the furnace, including holding time at the target temperature, is not to exceed 3 minutes in any case. Heating with contact of a fluid medium would also be possible. Both blanks and also profiles can also be heated by means of direct stream flow.

It is also possible that the blank or the profile, respectively, is coated before the thermal treatment, i.e., before the heating and/or before or during the cooling. The coating is used to intentionally influence the temperature introduction and/or the temperature dissipation by means of heat conduction. The heating rate or cooling rate can thus be improved. The coating can also be applied in a locally differing manner, so that different temperatures from one another are set regionally in the blank during the thermal treatment.

However, the contact heating is carried out at heating rates greater than 15 K/s, or greater than 20 K/s, or greater than 25 K/s, or greater than 35 K/s, or greater than 50K/s.

Furthermore, contact cooling is carried out for the quenching. Cooling rates greater than 15 K/s, or greater than 17 K/s, or greater than 25 K/s, or greater than 29 K/s, or greater than 50K/s are used here. A heating rate greater than 500 K/s is supposed to be technically restricted.

The present disclosure furthermore relates to the use of an aluminum alloy for producing a motor vehicle component, wherein the aluminum alloy comprises the following alloy components, expressed in weight-percent:

| | |
|---|---|
| silicon (Si) | 0.60 to 1.00, or 0.60 to 0.90 |
| magnesium (Mg) | 0.65 to 0.95 |
| copper (Cu) | 0.25 to 0.90 |
| manganese (Mn) | 0.10 to 0.20 |
| chromium (Cr) | up to 0.10 |
| titanium (Ti) | 0.01 to 0.10 |
| iron (Fe) | 0.10 to 0.30 |

remainder aluminum and smelting-related contaminants.

According to the disclosure, the blank is firstly heated at a heating rate greater than 15 K/s. The heated blank is then quenched at a cooling rate greater than 15 K/s. The blank thus thermally treated is subsequently cold formed. The forming takes place within 30 seconds after completion of the heating. A grain size in the material microstructure between 20 and 50 μm can thus be set in a motor vehicle component, produced from the above-mentioned alloy.

BRIEF DESCRIPTION OF THE DRAWINGS

Further advantages, features, properties, and aspects of the present disclosure are the subject matter of the following description. Design variants are illustrated in schematic figures. These figures are used for simpler comprehension of the disclosure. In the figures.

In the figures, the same reference signs are used for identical or similar components, even if a repeated description is omitted for reasons of simplification.

DETAILED DESCRIPTION

Figure 1:
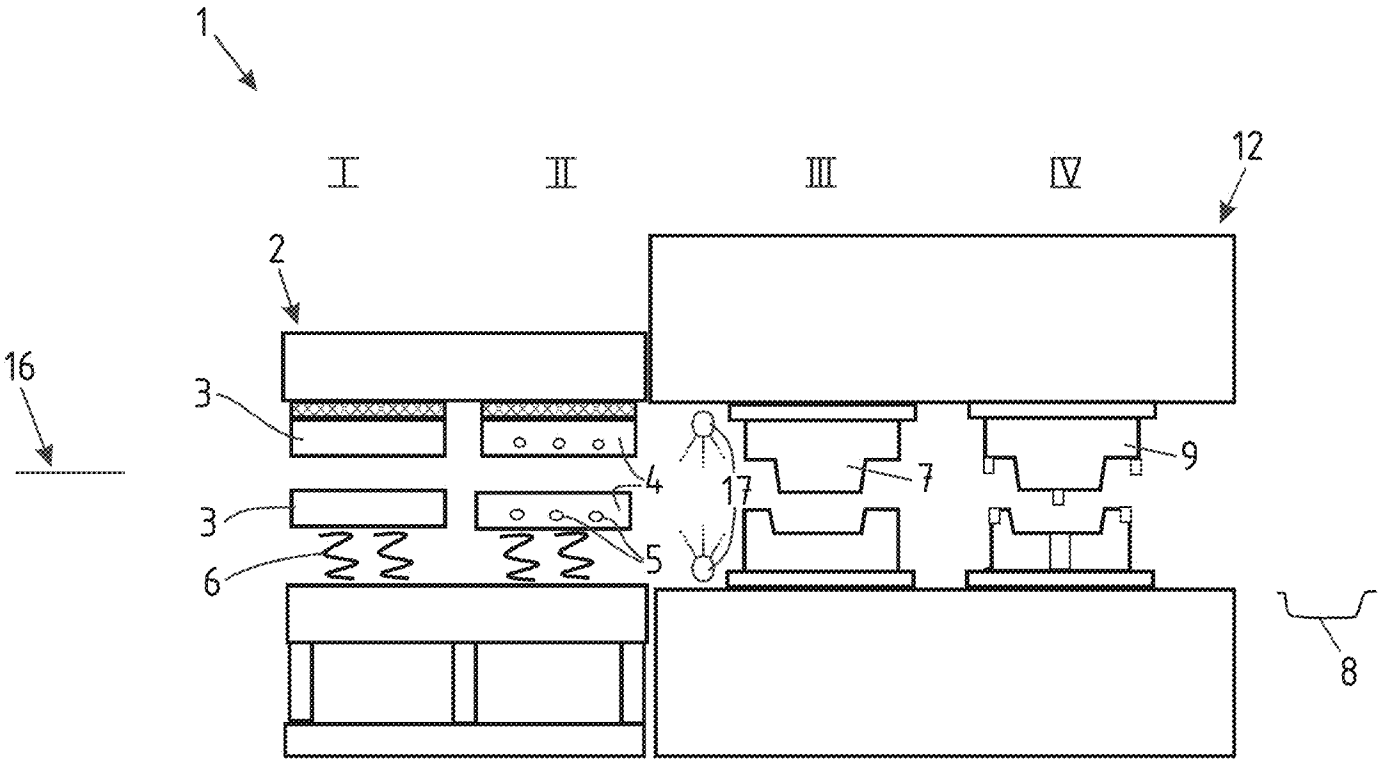
FIG. 1 shows an arrangement for carrying out the method according to the disclosure having a tempering station and a forming and trimming station according to at least one embodiment.

FIG. 1 shows an arrangement 1 for carrying out the method according to the disclosure. The arrangement 1 comprises a combined tempering station 2. In a first step I, a heating procedure takes place. For this purpose, contact plates 3 are provided, which are heated via a heat source (not shown in greater detail) and heat the inserted blank 16 via heat conduction by means of facility contact. Hereafter, a blank inserted in the respective step is also shown for reasons of simplification. A second step II provides cooling plates 4. The cooling plates 4 comprise cooling ducts 5 for conducting through a coolant fluid. The heated blank is thus cooled in the second step by facility contact. Both the contact plates 3 and also the cooling plates 4 are each mounted via springs 6. The effective contact time can be lengthened in this way during the tool closing time and/or execution of the cycle, since the plates protrude in the tool closing direction. The contact pressure is also homogenized and a press deflection is compensated for. A lubricating facility 17 is optionally provided after the quenching, which applies a lubricant to the blank by means of spraying, for example.

The blank heated in the first step I and quenched in the second step II is then transferred in a third step III in a forming station 12. A forming tool 7 is provided here, for a first forming of the motor vehicle component 8 to be produced. A subsequent fourth step IV can also comprise a perforating and/or trimming tool 9 alternatively or additionally to a forming step. Alternatively or additionally, further forming can also take place in this combined perforating or trimming tool 9. At the end of the method, the formed motor vehicle component 8 is obtained, which is a motor vehicle component formed hat-shaped in cross section by way of example here. The motor vehicle component can be a motor vehicle column, a longitudinal beam or crossbeam, or another vehicle body component or structural component, alternatively also a chassis component, outer skin component, or add-on part on a motor vehicle. A transfer system for the further transport of the blank is not shown.

Figure 2:
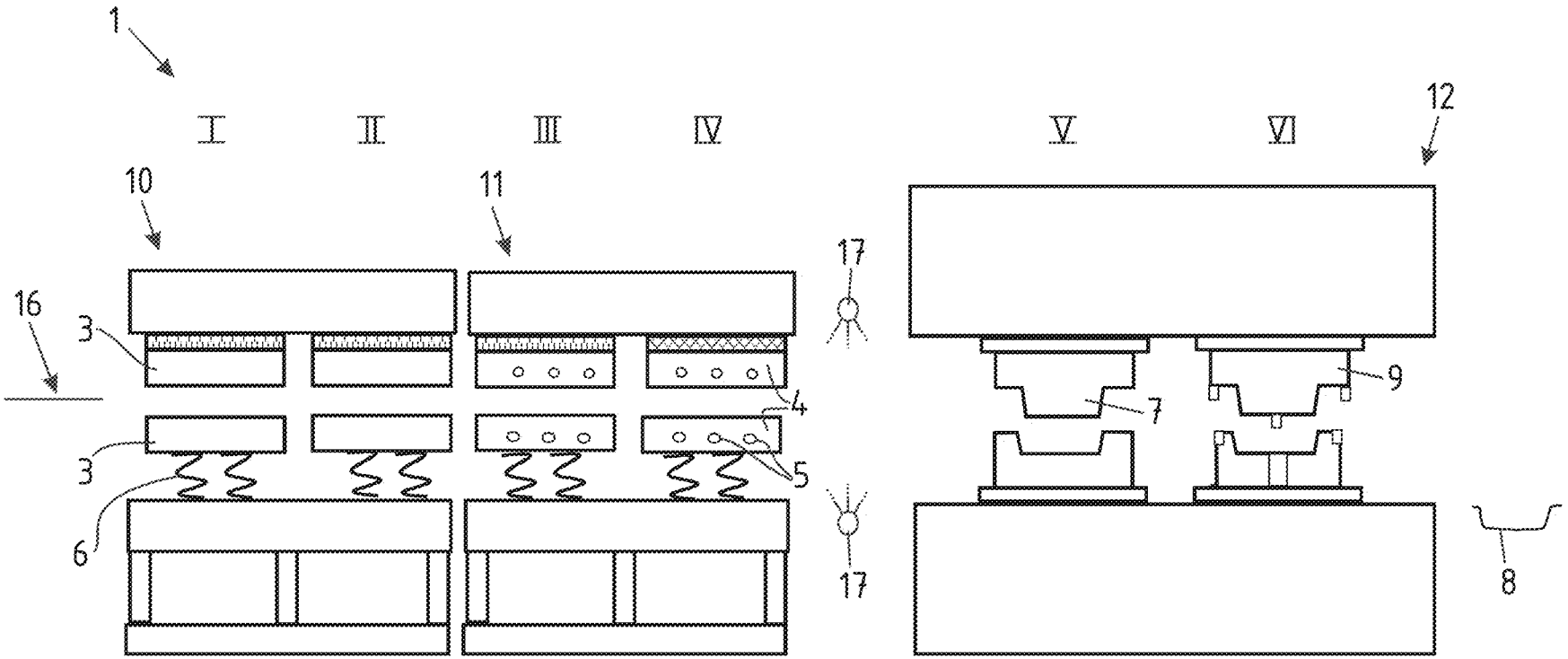
FIG. 2 shows an alternative arrangement to FIG. 1 according to at least one embodiment.

FIG. 2 shows an alternative embodiment variant to FIG. 1. An arrangement 1 is also shown here which provides a heating station 10, a cooling station 11, and a forming station 12. Overall, a six-step tempering and forming process is carried out, wherein firstly heating is performed in the first two steps I+II in the heating station 10. This heated blank 16 is transferred to a cooling station 11 subsequently thereto and quenched in the cooling station 11 in step III and step IV. The heated and subsequently quenched blank 16 is then transferred in a fifth step V into a forming tool 7 and formed in at least one step here and also optionally formed once again and also trimmed and perforated in a sixth step VI. The application of lubricant takes place between steps IV and V, for example by means of spraying on both sides. This can be performed using the lubricating facility 17. A motor vehicle component 8 is obtained, which is also configured hat-shaped in cross section here by way of example.

Figure 3:
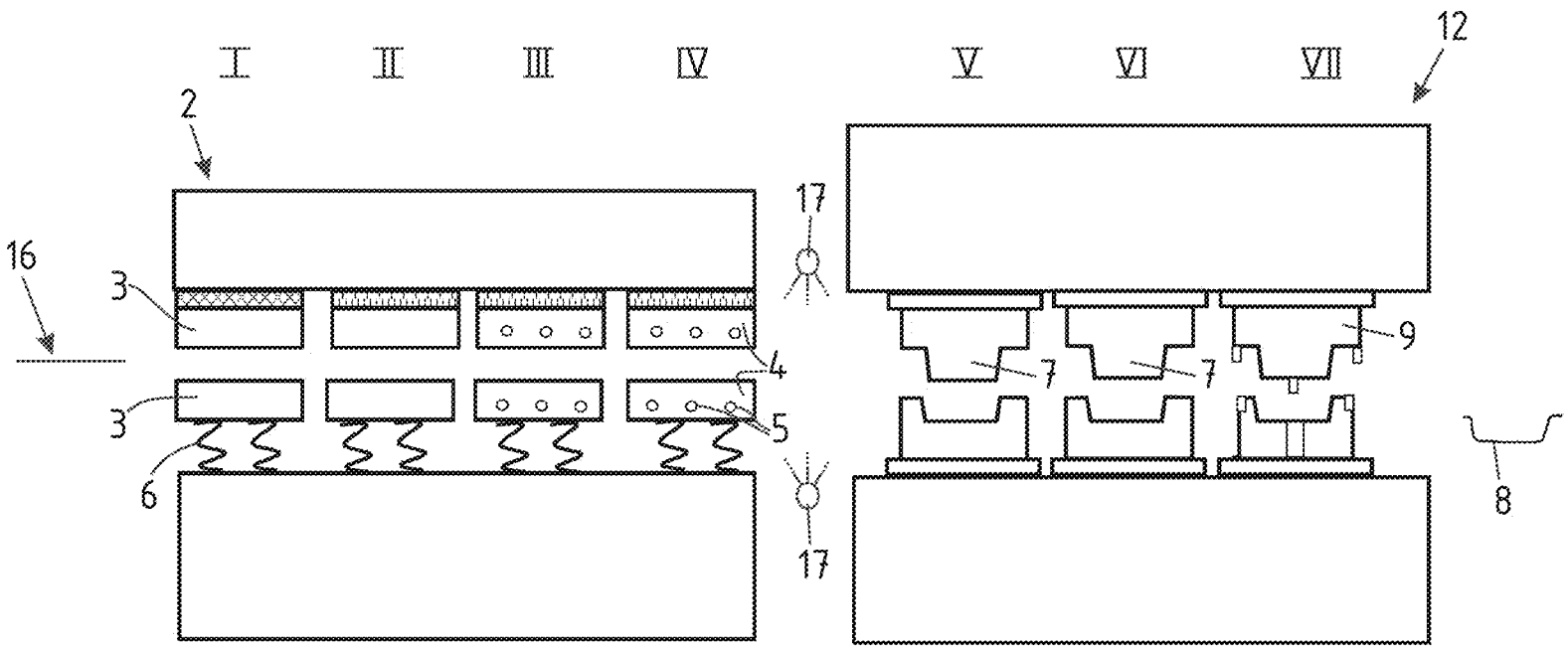
FIG. 3 shows an alternative arrangement to FIG. 1 according to at least one embodiment.

FIG. 3 shows an alternative arrangement thereto. A tempering station 2 is again provided here, which both heats and also cools. The process is shown in seven steps. The first four steps are carried out in the tempering station 2. For this purpose, heating is performed in step I and step II. A quenching procedure takes place in steps III and IV. The blank thus tempered is then transferred to a forming station 12 and formed and also trimmed and perforated here in three further steps V-VII. The application of lubricant is performed between step IV and V, for example by means of spraying on both sides.

Figure 4:
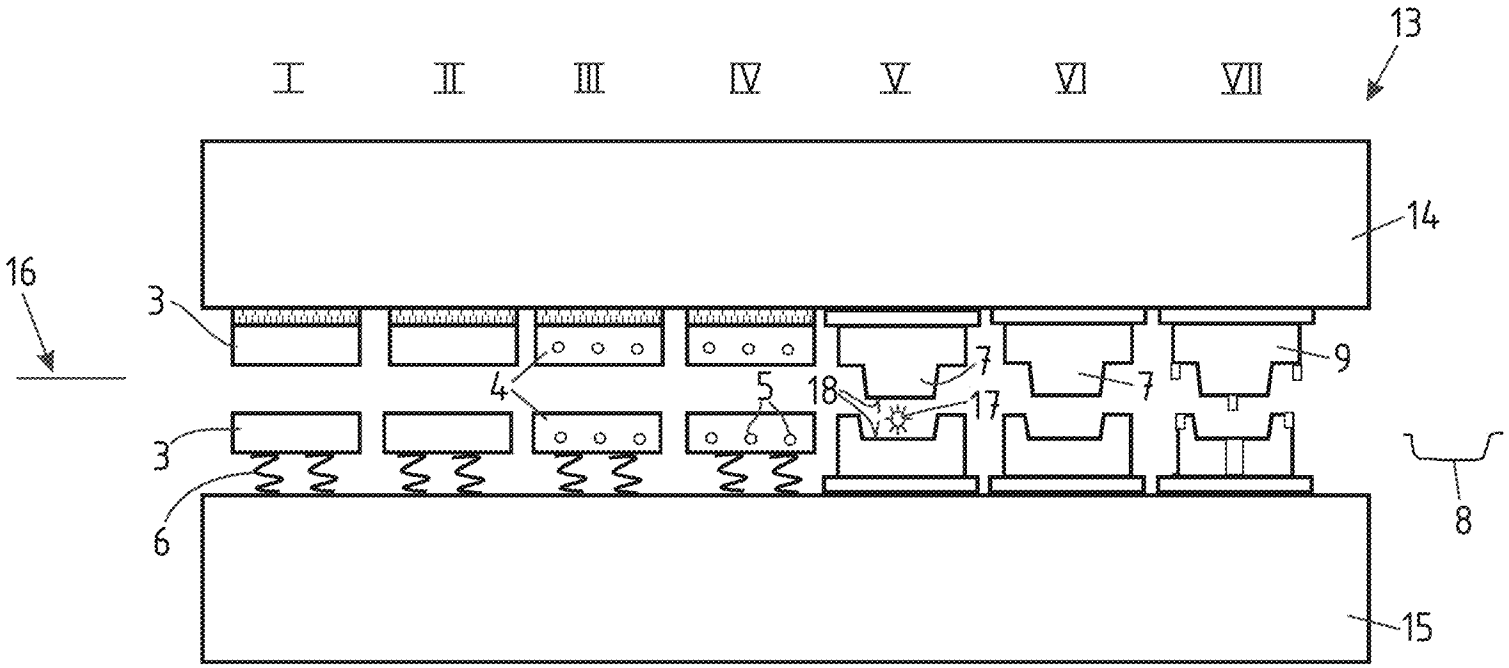
FIG. 4 shows an alternative arrangement to FIG. 1 according to at least one embodiment.

FIG. 4 shows an alternative design variant. A joint tempering and forming station 13 is illustrated here. This means all contact plates 3, cooling plates 4, forming tool 7, and perforating and trimming tools 9 are suspended and/or fixed on a press top part 14 and press bottom part 15. A closing movement of the tempering and forming station 13 thus causes all steps I-VII to be executed simultaneously. Springs 6 are again also provided here, so that the effective contact time of contact plates 3 and also cooling plates 4 is lengthened during the movement of, for example, top tool 14 toward bottom tool 15. A lubricating facility 17 is furthermore shown here in the first forming step V. It applies lubricant to the forming jaws 18 of the forming tools 7.

Figure 5:
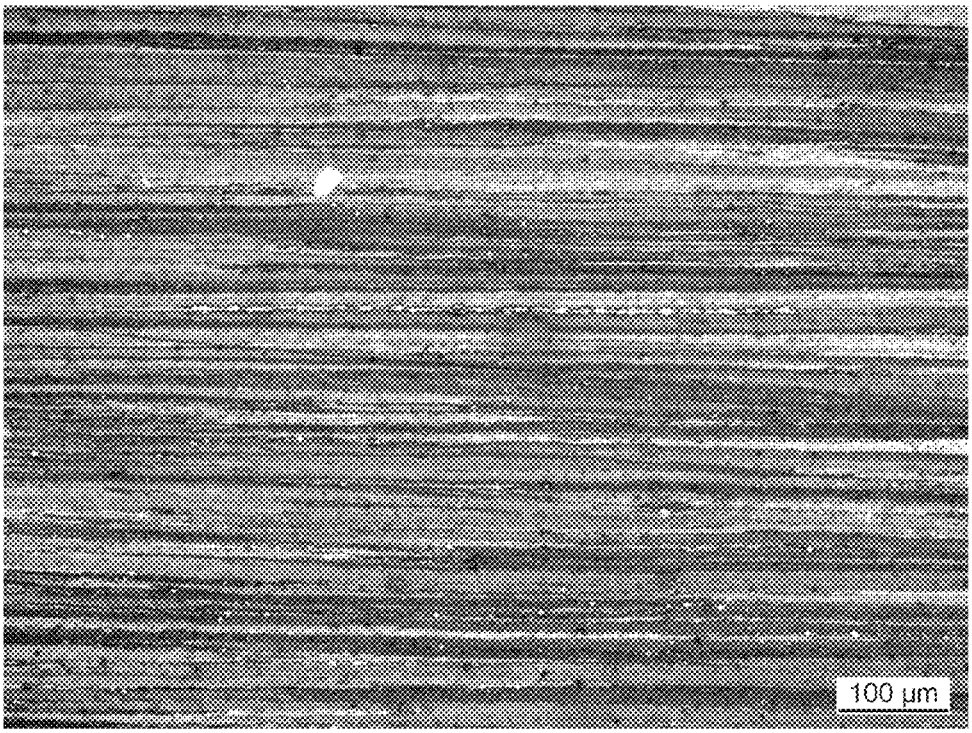
FIGS. 5 to 7 show metallurgical microsections according to at least one embodiment.

FIG. 5 shows a metallurgical microsection of a blank made of the described aluminum alloy according to the disclosure in the provided state. A laminar structure can be seen here.

Figure 6:
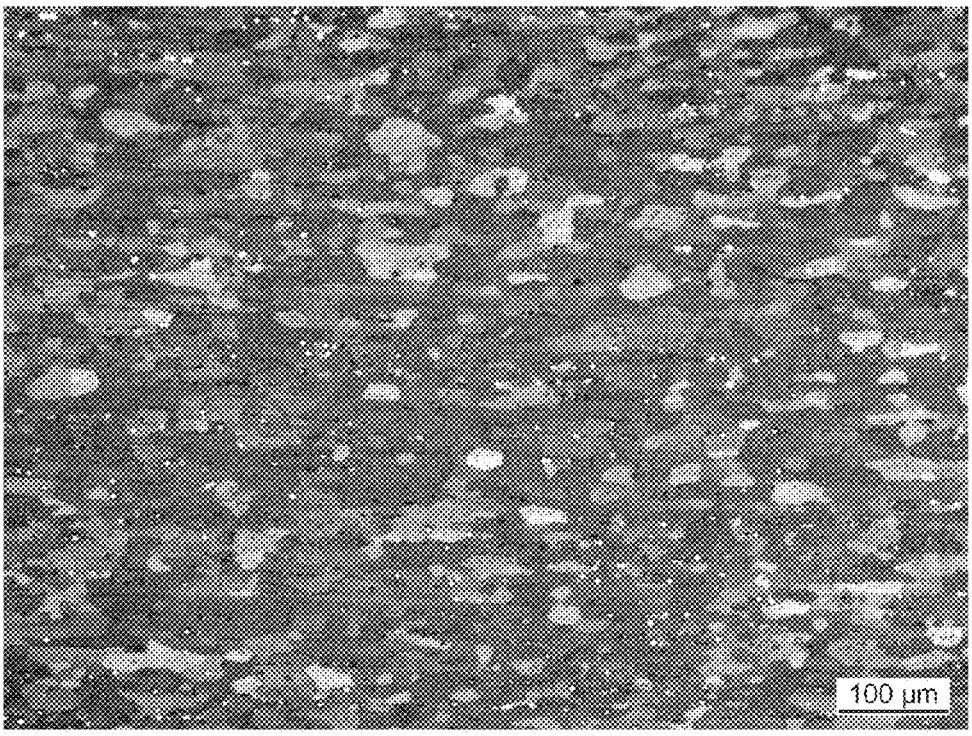

If rapid heating with subsequent quenching according to the disclosure is now carried out, the material microstructure shown in FIG. 6 is thus provided. It can be seen here that individual grains have formed which each have a grain size between 20 and 50 μm. The size specification relates to both a length and width extension in the image plane, and also a height extension into the image plane or out of the image plane. The grain size is thus formed equiaxially. After the subsequent forming, the grain size is formed essentially equal. The orientation of the grains is slightly distorted depending on the stretching occurring within the wall thickness during the forming procedure.

Figure 7:
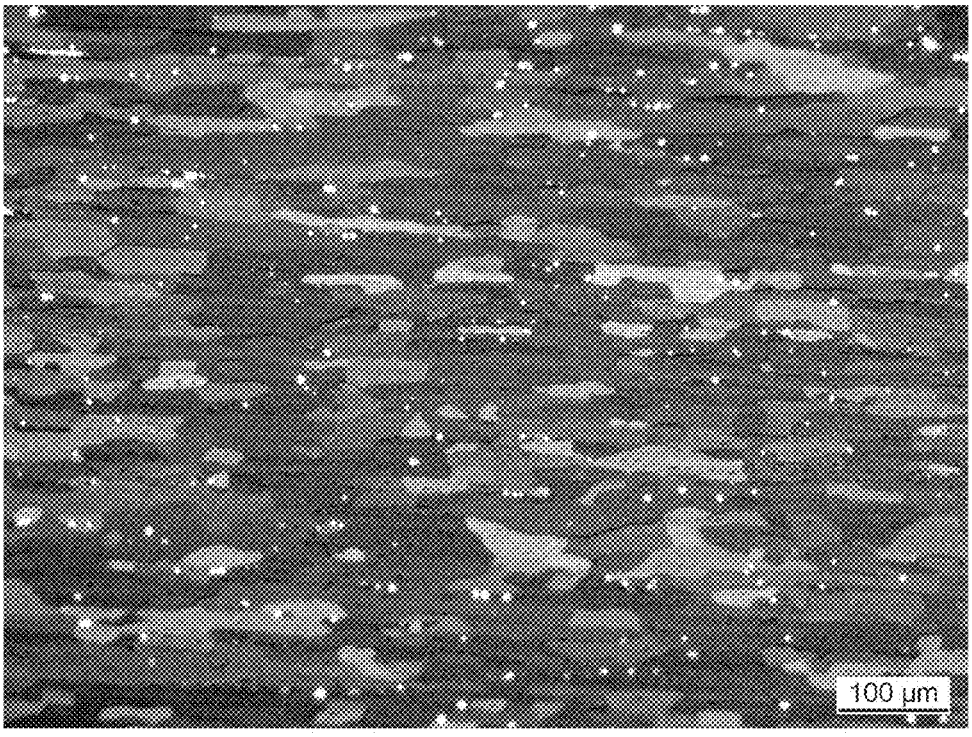

In contrast thereto, FIG. 7 shows a material microstructure as was produced using slower and longer lasting heating and also slower and longer lasting cooling, over multiple minutes in each case. It can be seen that a significantly larger grain size and also different grain structure than in FIG. 6 results.

The foregoing description of some embodiments of the disclosure has been presented for purposes of illustration and description. It is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A method of producing a motor vehicle component from a 6000-series aluminum alloy, the method comprising:

rapid heating of a blank comprising 6000-series aluminum alloy, using contact plates, to a temperature between 450° C. and 600° C. in a time of less than 20 seconds, ending the rapid heating in response to obtaining a grain size between 20 and 50 μm, quenching the blank to a temperature of less than or equal to 100° C., in a time of less than 20 seconds to form a tempered blank, the rapid heating and the quenching of the blank is performed in a total time of less than 50 seconds, applying a lubricant at 20° C. to 100° C. to the tempered blank, forming the tempered blank in a forming tool, the time between beginning of the rapid heating and beginning of the forming is less than 50 seconds, and stabilizing or aging the tempered blank, wherein the 6000-series aluminum alloy comprises the following alloy elements, expressed in weight-percent:

| | |
|---|---|
| silicon (Si) | 0.60 to 1.00 |
| magnesium (Mg) | 0.65 to 0.95 |
| copper (Cu) | 0.25 to 0.90 |

remainder aluminum and smelting-related contaminants.

2. The method according to claim 1, wherein the aluminum alloy comprises copper at 0.25-0.65.

3. The method according to claim 1, wherein the aluminum alloy comprises copper at 0.65-0.90 weight-percent.

4. The method according to claim 1, wherein the aluminum alloy further comprises at least one of the following alloy elements, expressed in weight-percent:

| | |
|---|---|
| manganese (Mn) | 0.10 to 0.20 |
| chromium (Cr) | up to 0.10 |
| titanium (Ti) | 0.01 to 0.10 |
| iron (Fe) | 0.10 to 0.30. |

5. The method according to claim 1, wherein a yield strength Rp0.2 of the 6000-series aluminum alloy tempered blank greater than 260 MPa is set from the stabilizing or the aging.

6. The method according to claim 1, wherein a yield strength Rp0.2 of the 6000-series aluminum alloy tempered blank greater than 320 MPa is set from the stabilizing or the aging.

7. The method according to claim 1, wherein a ratio of yield strength to tensile strength of the 6000-series aluminum alloy tempered blank less than or equal to 0.95 is set from the stabilizing or the aging.

8. The method according to claim 1, wherein the blank is in the roll-hardened state before the heating.

9. The method according to claim 1, wherein the heating or the quenching of the 6000-series aluminum alloy is performed locally.

10. The method according to claim 1, wherein the heating or the quenching of the blank is with different contact pressure, or using the contact plates having different temperatures in the heating or the quenching to obtain different regions of the blank based on the different temperatures.

11. The method according to claim 1, wherein the heating is performed by contact heating at a heating rate greater than 20 K/s.

12. The method according to claim 1, wherein the contact plates comprise a coating.

13. The method according to claim 1, further comprising cooling, wherein the heating, the cooling, and/or the forming is performed in multiple stages.

14. The method according to claim 1, wherein the aluminum alloy comprises the following alloy components, expressed in weight-percent:

| | |
|---|---|
| silicon (Si) | 0.60 to 1.00, preferably 0.60 to 0.90 |
| magnesium (Mg) | 0.65 to 0.95 |
| copper (Cu) | 0.25 to 0.90 |
| manganese (Mn) | 0.10 to 0.20 |
| chromium (Cr) | up to 0.10 |
| titanium (Ti) | 0.01 to 0.10 |
| iron (Fe) | 0.10 to 0.30 |

remainder aluminum and smelting-related contaminants, wherein the heating of the blank is a heating rate of greater than 4 K/s, the quenching of the blank is at a cooling rate of greater than 10 K/s, and cold forming of the motor vehicle component is performed within less than 50 seconds after the heating.

15. The method according to claim 14, wherein the motor vehicle component comprises a yield strength Rp0.2 of greater than 260 MPa and a ratio of yield strength to tensile strength of less than or equal to 0.95 and is selected from the group consisting of:

a motor vehicle column, a tunnel, longitudinal beam or crossbeam, a rocker panel, a door frame, reinforcements and stiffening elements, and a battery mount, frame, reinforcements and/or stiffening elements.

16. The method according to claim 1, wherein a yield strength Rp0.2 of the 6000-series aluminum alloy tempered blank greater than 280 MPa and less than 340 MPa is set.

17. The method according to claim 1, wherein a yield strength Rp0.2 of the 6000-series aluminum alloy tempered blank greater than 280 MPa and less than 320 MPa is set.

18. The method according to claim 1, wherein the heating of the blank is at a heating rate greater than 15 K/s.

19. The method according to claim 1, wherein the quenching of the blank is at a cooling rate greater than 15 K/s.

20. The method according to claim 1, wherein the aluminum alloy comprises the following alloy elements, expressed in weight-percent:

| | |
|---|---|
| silicon (Si) | 0.60 to 0.90 |
| magnesium (Mg) | 0.65 to 0.95 |
| copper (Cu) | 0.25 to 0.90 |

remainder aluminum and smelting-related contaminants.

21. The method according to claim 1, wherein the aluminum alloy comprises the following alloy components, expressed in weight-percent:

| | |
|---|---|
| silicon (Si) | 0.60 to 0.90 |
| magnesium (Mg) | 0.65 to 0.95 |
| copper (Cu) | 0.25 to 0.90 |
| manganese (Mn) | 0.10 to 0.20 |
| chromium (Cr) | up to 0.10 |
| titanium (Ti) | 0.01 to 0.10 |
| iron (Fe) | 0.10 to 0.30 |

remainder aluminum and smelting-related contaminants, wherein the heating of the blank is a heating rate of greater than 4 K/s, the quenching of the blank is at a cooling rate of greater than 10 K/s, and cold forming of the motor vehicle component is performed within less than 50 seconds after the heating.

* * * * *